US011215342B2

(12) United States Patent
Luo et al.

(10) Patent No.: US 11,215,342 B2
(45) Date of Patent: Jan. 4, 2022

(54) SPLIT-TYPE CEILING LAMP

(71) Applicants: Zhejiang Jiawang Optoelectronics Technology Co., Ltd., Zhejiang (CN); Haining Xinguangyuan Lighting Technology Co., Ltd., Zhejiang (CN)

(72) Inventors: Gaowang Luo, Jiaxing (CN); Guocai Chen, Jiaxing (CN); Jianguo Zhu, Jiaxing (CN)

(73) Assignees: Zhejiang Jiawang Optoelectronics Technology Co., Ltd.; Haining Xinguangyuan Lighting Technology Co., Ltd.

( * ) Notice: Subject to any disclaimer, the term of this patent is extended or adjusted under 35 U.S.C. 154(b) by 0 days.

(21) Appl. No.: 16/984,521

(22) Filed: Aug. 4, 2020

(65) Prior Publication Data

US 2021/0215325 A1 Jul. 15, 2021

(51) Int. Cl.

| | |
|---|---|
| ***F21V 21/04*** | (2006.01) |
| ***F21V 19/00*** | (2006.01) |
| ***F21V 3/06*** | (2018.01) |
| ***F21S 8/04*** | (2006.01) |
| ***F21V 17/12*** | (2006.01) |
| ***F21V 17/18*** | (2006.01) |
| ***F21V 23/06*** | (2006.01) |
| ***H01R 13/73*** | (2006.01) |
| *F21Y 115/10* | (2016.01) |

(52) U.S. Cl.

CPC ..... *F21V 19/0045* (2013.01); *F21S 8/04* (2013.01); *F21V 3/062* (2018.02); *F21V 17/12* (2013.01); *F21V 17/18* (2013.01); *F21V 23/06* (2013.01); *H01R 13/73* (2013.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 8,042,969 | B2 * | 10/2011 | Paik | F21V 5/007 362/241 |
| 9,109,783 | B1 * | 8/2015 | Davis | F21V 23/001 |
| 10,816,163 | B1 * | 10/2020 | Hsu | F21V 13/04 |
| 2012/0140442 | A1 * | 6/2012 | Woo | F21V 7/04 362/95 |
| 2019/0011119 | A1 * | 1/2019 | Zhong | F21V 3/061 |
| 2019/0234569 | A1 * | 8/2019 | Zhan | F21S 8/026 |
| 2019/0234577 | A1 * | 8/2019 | Zhan | F21S 8/04 |
| 2020/0148100 | A1 * | 5/2020 | Zhang | B60Q 1/326 |

* cited by examiner

*Primary Examiner* — Elmito Breval

(57) ABSTRACT

A split-type ceiling lamp comprising a lamp body, a diffusion cover and a base, wherein the lamp body is provided with an electric apparatus groove and a mounting groove. A light source is mounted in the electric apparatus groove, and the diffusion cover is clamped with the lamp body. The base is embedded in the mounting groove and is provided with a wiring terminal, which is connected to the light source through a power coupling module. The power coupling module comprises a socket portion and a connector portion. The socket portion is connected to the light source, the connector portion is connected to the wiring terminal, and the base is clamped with the lamp body. According to the present disclosure, the base with light weight and small volume is fixed on the ceiling first, and then the lamp body is clamped with the base, which achieves convenient assembly and disassembly.

9 Claims, 4 Drawing Sheets

SPLIT-TYPE CEILING LAMP

TECHNICAL FIELD

This disclosure generally relates to the technical field of lighting fixtures, and more particularly, to a split-type ceiling lamp.

BACKGROUND

A ceiling lamp is a kind of lighting fixture, which has a comparatively flat upper portion and a bottom completely attached to the ceiling during installation. The light source adopted in the ceiling lamp may be an incandescent light, a fluorescent light, a high-intensity gas-discharge light, a halogen tungsten light or an LED light, etc. Presently, LED ceiling lamps are the most popular ones sold on the market, which are widely used in homes, offices and entertainment places, etc.

Conventional ceiling lamps normally include two detachable parts: a lamp cover and a lamp body, wherein the lamp body is directly fixed on the ceiling using screws, and the lamp cover is clamped with the lamp body for covering it. The shortcoming of the aforesaid structure is: the lamp body fixed on the ceiling makes the disassembly troublesome, resulting in difficult replacement and maintenance of the light source. Meanwhile, the light source and other components on the lamp body increase the weight of the lamp body, making the fixation of the lamp body on the ceiling more inconvenient. As a result, the fixation and installation of the ceiling lamp are laborious and cannot be completed by one person.

SUMMARY

The purpose of the present disclosure is to provide a split-type ceiling lamp.

To achieve the above purpose, the present disclosure adopts the following technical solution: a split-type ceiling lamp comprising a lamp body, a diffusion cover and a base, wherein one side of the lamp body is provided with an electric apparatus groove, and the other side of the lamp body is provided with a mounting groove, wherein a light source is fixedly mounted in the electric apparatus groove, and the diffusion cover is clamped with the lamp body and covers the electric apparatus groove, wherein one side of the base is embedded in the mounting groove, and the other side of the base is provided with a wiring terminal, which is electrically connected to the light source through a power coupling module, wherein the power coupling module further comprises a socket portion mounted in the mounting groove and a connector portion mounted on the base, wherein the socket portion is connected to the light source, the connector portion is connected to the wiring terminal, and the base is clamped with the lamp body.

In another preferred embodiment, the cross-section of the mounting groove is circular. The socket portion comprises an outer ring sleeve and an inner ring sleeve, wherein the outer ring sleeve, the inner ring sleeve, and the mounting groove are coaxially arranged. An outer inserting hole is formed between the outer ring sleeve and the inner ring sleeve, and an inner inserting hole is formed in the inner ring sleeve. The outer inserting hole is communicated with the electric apparatus groove through an outer arc-shaped through hole, and the inner inserting hole is communicated with the electric apparatus groove through an inner arc-shaped through hole. The light source comprises a positive electrode connecting wire and a negative electrode connecting wire, wherein the positive electrode connecting wire is connected to a positive electrode conductive elastic sheet, and the negative electrode connecting wire is connected to a negative electrode conductive elastic sheet. One end of the positive electrode conductive elastic sheet is fixed in the electric apparatus groove, and the other end of the positive electrode conductive elastic sheet extends into the inner inserting hole through the inner arc-shaped through hole after being bent. One end of the negative electrode conductive elastic sheet is fixed in the electric apparatus groove, and the other end of the negative electrode conductive elastic sheet extends into the outer inserting hole through the outer arc-shaped through hole after being bent. The base is matched with the mounting groove, and a circular inserting groove is formed in the middle of one side of the base which is embedded in the mounting groove. The circular inserting groove is internally fixed with an outer conductive ring and an inner conductive ring, wherein the outer conductive ring, the inner conductive ring, and the circular groove are coaxially arranged. A plurality of through holes are formed in the bottom of the circular inserting groove. One end of the outer conductive ring and one end of the inner conductive ring are respectively provided with a plurality of pins, and the pins are in one-to-one correspondence with the through holes. The pins are bent to form a pressing portion after passing through the corresponding through holes, wherein one pin of the outer conductive ring is connected to a negative electrode conductive piece through a through hole, and one pin of the inner conductive ring is connected to a positive electrode conductive piece through a through hole. The negative electrode conductive piece and the positive electrode conductive piece are respectively connected to the wiring terminal through wires.

In another preferred embodiment, a plurality of clamping blocks which are uniformly arranged at intervals are fixed to the sidewall of the mounting groove, and a plurality of clamping openings are formed in the sidewall of the base. The clamping openings are communicated with one side of the base which is embedded into the mounting groove through receding openings, and the clamping blocks one-to-one correspond to the clamping openings.

In another preferred embodiment, the wiring terminal is a push-type wiring terminal.

In another preferred embodiment, a convex column is arranged in the inner ring sleeve and is coaxially arranged with the inner ring sleeve. An inner inserting hole is formed between the convex column and the inner ring sleeve.

In another preferred embodiment, a small cover plate is connected to the base through a screw, and the small cover plate covers the negative electrode conductive elastic sheet and the positive electrode conductive elastic sheet.

In another preferred embodiment, the base is provided with a plurality of screw fixing holes.

In another preferred embodiment, the light source is an LED light source.

In another preferred embodiment, both the lamp body and the diffusion cover are circular.

In another preferred embodiment, the lamp body and the base are made of plastic, and the diffusion cover is a PC diffusion cover.

Compared with the prior art, the present disclosure has the following advantages: according to the present disclosure, the base with light weight and small volume is fixed on the ceiling first, and then the lamp body is clamped with the base, which achieves convenient assembly and disassembly.

DETAILED DESCRIPTION

Detailed embodiments are combined hereinafter to clearly and completely describe the technical solution of the present disclosure. Obviously, the described embodiments are merely a part but not all of the embodiments of the present disclosure. The specification of the present disclosure may allow those skilled in the art to obtain other embodiments without paying creative labor, and thus all of which shall fall into the scope of the present disclosure.

In the description of the present disclosure, it should be understood that the orientations or positions indicated by terms "central", "upper", "lower", "left", "right", "vertical", "horizontal", "inner" and "outer" are based on the orientations or positions shown in the figures, which are merely used for conveniently describing the present disclosure and simplifying the description but not for indicating or implying that the device or element referred to must have a specific orientation, be constructed and operated in a specific orientation. Thus, the aforesaid cannot be understood as a limitation of the present disclosure. In addition, the terms "first" and "second" are merely used for descriptive purposes and cannot be understood as indicating or implying a relative importance.

In the description of the present disclosure, unless it is clearly stated, the terms "installation" and "connection" should be understood in a broad sense. For instance, the "connection" may be a fixed connection, a detachable connection, an integrated connection, a mechanical connection, an electrical connection, a direct connection, an indirect connection through an intermediary or an internal connection between two components. For those skilled in the art, the specific meaning of the aforesaid terms in the present disclosure may be understood according to the specific situation.

Figure 1:
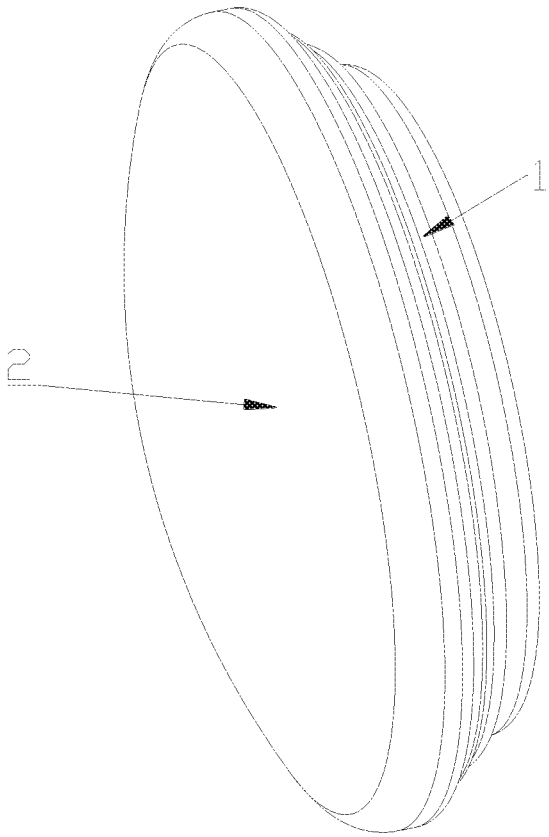
FIG. 1 is a three-dimensional diagram illustrating an example structure of the present disclosure.
Figure 2:
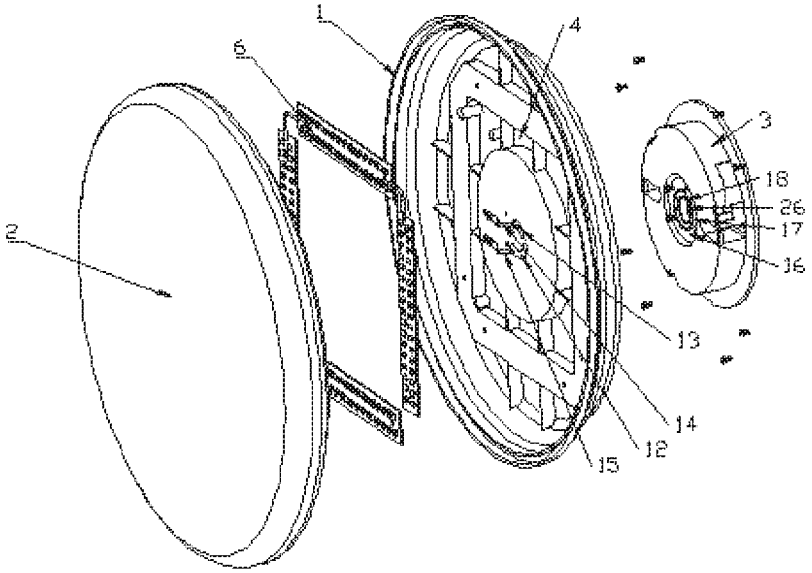
FIG. 2 is a conceptual diagram illustrating an explosive view of the present disclosure.
Figure 3:
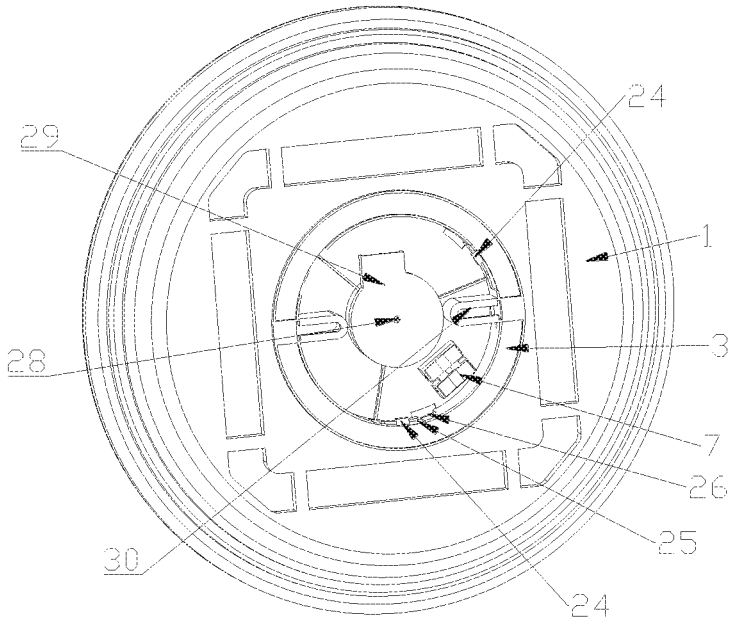
FIG. 3 is a conceptual diagram illustrating a rear view of the present disclosure.
Figure 4:
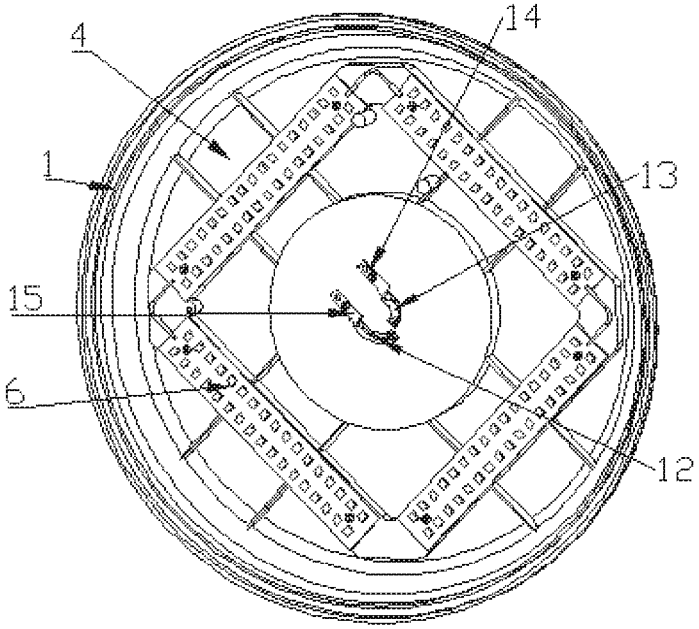
FIG. 4 is a conceptual diagram illustrating an example structure of the lamp body of the present disclosure.
Figure 5:
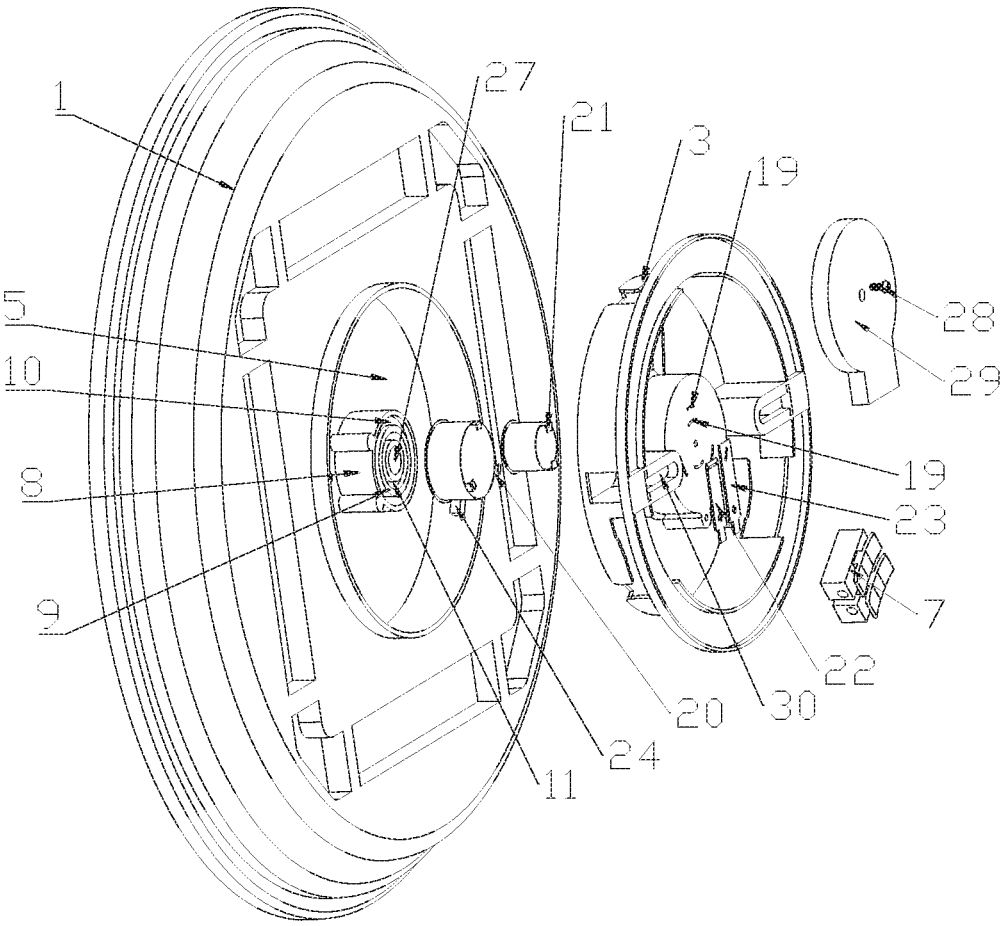
FIG. 5 a conceptual diagram illustrating an explosive view of the present disclosure from another viewing angle.

As shown in FIGS. 1-5, a split-type ceiling lamp comprises a lamp body 1, a diffusion cover 2 and a base 3, wherein one side of the lamp body 1 is provided with an electric apparatus groove 4, and the other side of the lamp body 1 is provided with a mounting groove 5. A light source 6 is fixedly mounted in the electric apparatus groove 4, and the diffusion cover 2 is clamped with the lamp body 1 and covers the electric apparatus groove 4. One side of the base 3 is embedded in the mounting groove 5, and the other side of the base 3 is provided with a wiring terminal 7, which is electrically connected to the light source 6 through a power coupling module. The power coupling module further comprises a socket portion mounted in the mounting groove 5 and a connector portion mounted on the base 3. The socket portion is connected to the light source 6, the connector portion is connected to the wiring terminal 7, and the base 3 is clamped with the lamp body 1.

Further, the cross section of the mounting groove 5 is circular. The socket portion comprises an outer ring sleeve 8 and an inner ring sleeve 9, wherein the outer ring sleeve 8, the inner ring sleeve 9 and the mounting groove 5 are coaxially arranged. An outer inserting hole 10 is formed between the outer ring sleeve 8 and the inner ring sleeve 9, and an inner inserting hole 11 is formed in the inner ring sleeve 9. The outer inserting hole 10 is communicated with the electric apparatus groove 4 through an outer arc-shaped through hole 12, and the inner inserting hole 11 is communicated with the electric apparatus groove 4 through an inner arc-shaped through hole 13. The light source 6 comprises a positive electrode connecting wire and a negative electrode connecting wire, wherein the positive electrode connecting wire is connected to a positive electrode conductive elastic sheet 14, and the negative electrode connecting wire is connected to a negative electrode conductive elastic sheet 15. One end of the positive electrode conductive elastic sheet 14 is fixed in the electric apparatus groove 4, and the other end of the positive electrode conductive elastic sheet 14 extends into the inner inserting hole 11 through the inner arc-shaped through hole 13 after being bent. One end of the negative electrode conductive elastic sheet 15 is fixed in the electric apparatus groove 4, and the other end of the negative electrode conductive elastic sheet 15 extends into the outer inserting hole 10 through the outer arc-shaped through hole 12 after being bent. The base 3 is matched with the mounting groove 5, and a circular inserting groove 16 is formed in the middle of one side of the base 3 which is embedded in the mounting groove 5. The circular inserting groove 16 is internally fixed with an outer conductive ring 17 and an inner conductive ring 18, wherein the outer conductive ring 17, the inner conductive ring 18 and the circular inserting groove 16 are coaxially arranged. A plurality of through holes 19 are formed in the bottom of the circular inserting groove 16. One end of the outer conductive ring 17 and one end of the inner conductive ring 18 are respectively provided with a plurality of pins 20, and the pins 20 are in one-to-one correspondence with the through holes 19. The pins 20 are bent to form a pressing portion 21 after passing through the corresponding through holes 19, wherein one pin 20 of the outer conductive ring 17 is connected to a negative electrode conductive piece 22 through a through holes 19, and one pin 20 of the inner conductive ring 18 is connected to a positive electrode conductive piece 23 through a through holes 19. The negative electrode conductive piece 22 and the positive electrode conductive piece 23 are respectively connected to the wiring terminal 7 through wires.

Further, a plurality of clamping blocks 24 which are uniformly arranged at intervals are fixed to the sidewall of the mounting groove 5, and a plurality of clamping openings 25 are formed in the sidewall of the base 3. The clamping openings are communicated with one side of the base 3 which is embedded into the mounting groove 5 through receding openings 26, and the clamping blocks 24 one-to-one correspond to the clamping openings 25. During installation, the base 3 is embedded into the mounting groove 5 first, and then the lamp body 2 is rotated to enable the clamping blocks 24 to be embedded into the receding openings 26. Subsequently, the lamp body is rotated again, and the clamping blocks 24 are clamped into the clamping openings 25, thus completing the installation of the lamp body 1 and the base 3. After the base 3 is embedded into the mounting groove 5, the outer ring sleeve 8 and the inner ring sleeve 9 are respectively inserted into the circular inserting groove 16. The outer conductive ring 17 is inserted into the outer inserting hole 10 and is electrically connected to the negative electrode conductive elastic sheet 15. The inner conductive ring 18 is inserted into the inner inserting hole 11 and is electrically connected to the positive electrode conductive elastic sheet 14. The outer ring sleeve 8, the inner ring sleeve 9, the outer conductive ring 17, the inner conductive ring 18, the negative electrode conductive elastic sheet 15 and the positive electrode conductive elastic sheet 14 are combined to form a power coupling module. According to this design, the power connection is completed while the lamp body is rotated to be clamped with the base.

Further, the wiring terminal 7 is a push-type wiring terminal.

Further, a convex column is arranged in the inner ring sleeve 9 and is coaxially arranged with the inner ring sleeve 9. An inner inserting hole is formed between the convex column and the inner ring sleeve 9. A guide tube 27 may also be provided within the inner conductive ring 18, and the convex column is inserted into the guide tube 27 to achieve functions of positioning and guiding.

Further, a small cover plate 29 is connected to the base 3 through a screw 28, and the small cover plate 29 covers the negative electrode conductive elastic sheet 15 and the positive electrode conductive elastic sheet 14. The small cover plate 29 is made of an insulating material, which prevents the negative electrode conductive elastic sheet 15 and the positive electrode conductive elastic sheet 14 from being in contact with the ceiling. Thus, the electric leakage is avoided.

Further, the base 3 is provided with a plurality of screw fixing holes 30, and the base 3 is fixed on the ceiling through the screw fixing holes 30.

Further, the light source 6 is an LED light source.

Further, both the lamp body 1 and the diffusion cover 2 are circular.

Further, the lamp body 1 and the base 3 are made of plastic, and the diffusion cover 2 is a PC diffusion cover.

It is worth mentioning that technical features including the LED light source and the push-type wiring terminal of the present disclosure belong to the prior art. The specific structure, working principle, possible control mode and spatial arrangement of the aforesaid technical features may be conventional, which shall not be regarded as the inventive points of the present disclosure.

The above are merely preferred embodiments of the present disclosure. It should be understood that those skilled in the art may make improvements and modifications according to the specification of the present disclosure without paying creative labor. Therefore, the technical solutions obtained by those skilled in the art through logical analysis, reasoning or limited experiments based on the specification of the present disclosure shall all fall into the scope defined by the claims.

What is claimed is:

1. A split-type ceiling lamp, comprising:

a lamp body, a diffusion cover, and a base, wherein a first side of the lamp body is provided with a electric apparatus groove, and a second side of the lamp body is provided with a mounting groove, wherein a light source is fixedly mounted in the electric apparatus groove, and the diffusion cover is clamped with the lamp body and covers the electric apparatus groove, wherein a first side of the base is embedded in the mounting groove, and a second side of the base is provided with a wiring terminal, which is electrically connected to the light source through a power coupling module, wherein the power coupling module further comprises:

a socket portion mounted in the mounting groove and a connector portion mounted on the base, wherein the socket portion is connected to the light source, the connector portion is connected to the wiring terminal, and the base is clamped with the lamp body, wherein the cross section of the mounting groove is circular, wherein the socket portion comprises:

an outer ring sleeve and an inner ring sleeve, wherein the outer ring sleeve, the inner ring sleeve and the mounting groove are coaxially arranged, wherein an outer inserting hole is formed between the outer ring sleeve and the inner ring sleeve, and an inner inserting hole is formed in the inner ring sleeve, wherein the outer inserting hole is communicated with the electric apparatus groove through an outer arc-shaped through hole, and the inner inserting hole is communicated with the electric apparatus groove through an inner arc-shaped through hole, wherein the light source comprises a positive electrode connecting wire and a negative electrode connecting wire, wherein the positive electrode connecting wire is connected to a positive electrode conductive elastic sheet, and the negative electrode connecting wire is connected to a negative electrode conductive elastic sheet, wherein one end of the positive electrode conductive elastic sheet is fixed in the electric apparatus groove, and the other end of the positive electrode conductive elastic sheet extends into the inner inserting hole through the inner arc-shaped through hole after being bent, wherein one end of the negative electrode conductive elastic sheet is fixed in the electric apparatus groove, and the other end of the negative electrode conductive elastic sheet extends into the outer inserting hole through the outer arc-shaped through hole after being bent, wherein the base is matched with the mounting groove, and a circular inserting groove is formed in the middle of the first side of the base which is embedded in the mounting groove, wherein the circular inserting groove is internally fixed with an outer conductive ring and an inner conductive ring, wherein the outer conductive ring, the inner conductive ring and the circular groove are coaxially arranged, wherein a plurality of through holes are formed in the bottom of the circular inserting groove, wherein one end of the outer conductive ring and one end of the inner conductive ring are respectively provided with a plurality of pins, and the pins are in one-to-one correspondence with the through holes, wherein the pins are bent to form a pressing portion after passing through the corresponding through holes, wherein one pin of the outer conductive ring is connected to a negative electrode conductive piece through a through hole, and one pin of the inner conductive ring is connected to a positive electrode conductive piece through a through hole, wherein the negative electrode conductive piece and the positive electrode conductive piece are respectively connected to the wiring terminal through wires.

2. The split-type ceiling lamp of claim 1, wherein a plurality of clamping blocks which are uniformly arranged at intervals are fixed to a sidewall of the mounting groove, and a plurality of clamping openings are formed in a sidewall of the base, wherein the clamping openings are communicated with the first side of the base which is embedded into the mounting groove through receding openings, and the clamping blocks one-to one correspond to the clamping openings.

3. The split-type ceiling lamp of claim 1, wherein the wiring terminal is a push-type wiring terminal.

4. The split-type ceiling lamp of claim 1, wherein a convex column is arranged in the inner ring sleeve and is coaxially arranged with the inner ring sleeve, wherein an inner inserting hole is formed between the convex column and the inner ring sleeve.

5. The split-type ceiling lamp of claim 4, wherein a small cover plate is connected to the base through a screw, and the small cover plate covers the negative electrode conductive elastic sheet and the positive electrode conductive elastic sheet.

6. The split-type ceiling lamp of claim 1, wherein the base is provided with a plurality of screw fixing holes.

7. The split-type ceiling lamp of claim 1, wherein the light source is an LED light source.

8. The split-type ceiling lamp of claim 7, wherein both the lamp body and the diffusion cover are circular.

9. The split-type ceiling lamp of claim 1, wherein the lamp body and the base are made of plastic, and the diffusion cover is a PC diffusion cover.

* * * * *